US011700929B1

(12) United States Patent
Bourguignat et al.

(10) Patent No.: US 11,700,929 B1
(45) Date of Patent: Jul. 18, 2023

(54) APPLICATOR SYSTEM FOR APPLYING A COSMETIC PRODUCT

(71) Applicant: ELC MANAGEMENT LLC, Melville, NY (US)

(72) Inventors: David Bourguignat, Brooklyn, NY (US); Marc Emile Lechanoine, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 17/571,026

(22) Filed: Jan. 7, 2022

(51) Int. Cl.
*A45D 34/04* (2006.01)
*A45D 40/26* (2006.01)
*A45D 20/26* (2006.01)

(52) U.S. Cl.
CPC ..... *A45D 34/04* (2013.01); *A45D 20/26* (2013.01); *A45D 34/043* (2013.01); *A45D 34/045* (2013.01); *A45D 40/264* (2013.01); *A45D 40/265* (2013.01); *A45D 2200/055* (2013.01)

(58) Field of Classification Search
CPC .... A45D 34/04; A45D 34/041; A45D 34/042; A45D 34/043; A45D 34/045; A45D 34/046; A45D 40/26; A45D 40/261; A45D 40/262; A45D 40/264; A45D 40/265; A45D 40/267; A45D 2200/055
USPC ..... 401/126–130
See application file for complete search history.

(56) References Cited

U.S. PATENT DOCUMENTS 5,636,931 A * 6/1997 Gueret ..... A46B 11/0017 401/129
6,164,857 A * 12/2000 Wolfarth-Brooks ..... A45D 34/045 401/126
6,634,821 B2 * 10/2003 Gueret ..... B65D 47/126 401/126
6,789,970 B1 * 9/2004 Shearon ..... A46B 7/023 401/127
11,470,942 B2 * 10/2022 Song ..... A45D 34/045

* cited by examiner

*Primary Examiner* — David J Walczak
(74) *Attorney, Agent, or Firm* — Marshall, Gerstein & Borun LLP

(57) ABSTRACT

An applicator system for containing and dispensing a cosmetic substance may include a container defining a cavity and including an open first end, a dispensing mechanism operably coupled with the first end of the container, and an applicator. The dispensing mechanism includes an elongated body that includes first and second ends and an actuator assembly operably coupled therewith. The applicator is operably coupled with the actuator assembly and is positioned at or near the first end of the elongated body and the first end of the container. Upon engaging the actuator assembly, the applicator is urged towards the cavity of the container to collect a quantity of cosmetic substance.

17 Claims, 8 Drawing Sheets

APPLICATOR SYSTEM FOR APPLYING A COSMETIC PRODUCT

FIELD OF THE DISCLOSURE

The present disclosure generally relates to cosmetic, hair care, body care, and/or skincare products and, more particularly, to systems and approaches for applying such products.

BACKGROUND

Cosmetic, hair care, body care, and/or skincare products may be provided in a number of different containers, and may be applied using a number of varying approaches. As an example, a concealer product may be applied using a user's finger, an applicator brush, and/or a sponge product, among other alternatives. When applying such products, it may be difficult for a user to accurately dispense an appropriate quantity of product to provide coverage for the desired area. In instances where too much product is dispensed from the container, the excess product may be difficult and/or impossible to return to its container, and ultimately may need to be discarded, thereby resulting in wasted product. Conversely, in instances where too little product is dispensed from the container, the user's experience may be adversely impacted due to needing to repeatedly dispense additional product. Additionally, existing approaches may lack customization capabilities and may be difficult to use when attempting specific application techniques. Further, existing products may be disposable in nature, and as such may lead to environmental waste.

Accordingly, there is a need for improved accessories having improved functionalities.

SUMMARY

Examples within the scope of the present invention are directed an applicator system for containing and dispensing a cosmetic substance. Such a system may include a container defining a cavity and including an open first end, a dispensing mechanism operably coupled with the first end of the container, and an applicator. The dispensing mechanism includes an elongated body that includes first and second ends and an actuator assembly operably coupled therewith. The applicator is operably coupled with the actuator assembly and is positioned at or near the first end of the elongated body and the first end of the container. Upon engaging the actuator assembly, the applicator is urged towards the cavity of the container to collect a quantity of cosmetic substance.

In some examples, the actuator assembly is translatably coupled with the elongated body to permit relative movement therebetween. In some of these examples, the actuator assembly may further include a button and a resilient member. The resilient member may urge the button towards the second end of the elongated body whereby the applicator is positioned near the cavity of the container. Further, in some examples, a locking mechanism may be provided that prevents the button from being engaged.

In some forms, a retaining medium may be provided that suspends the cosmetic substance within the cavity. Then retaining medium may be at least one of a foam member or a mesh member.

In some approaches, the first end of the elongated body may include a mating member to releasably secure the dispensing mechanism with the container. In these and other approaches, the applicator may be removably coupled with the actuator assembly.

In some examples, the applicator may be constructed from a compressible material that compresses upon being urged towards the cavity of the container.

In accordance with a second approach, a dispensing mechanism for an applicator system containing a cosmetic substance includes an elongated shell having first and second ends, an actuator assembly at least partially disposed within the elongated shell, and an applicator including a base and a compressible member operably coupled therewith. The actuator assembly includes a button and a piston member operably coupled with the button. The piston member includes an applicator coupling mechanism. The base of the applicator includes a piston member coupling mechanism to operably couple with the applicator coupling mechanism of the piston member.

BRIEF DESCRIPTION OF THE DRAWINGS

The above needs are at least partially met through provision of one, more than one, or any combination of the approaches for applicator systems for applying a cosmetic product described in the following detailed description, particularly when studied in conjunction with the drawings, wherein.

Figure 1:
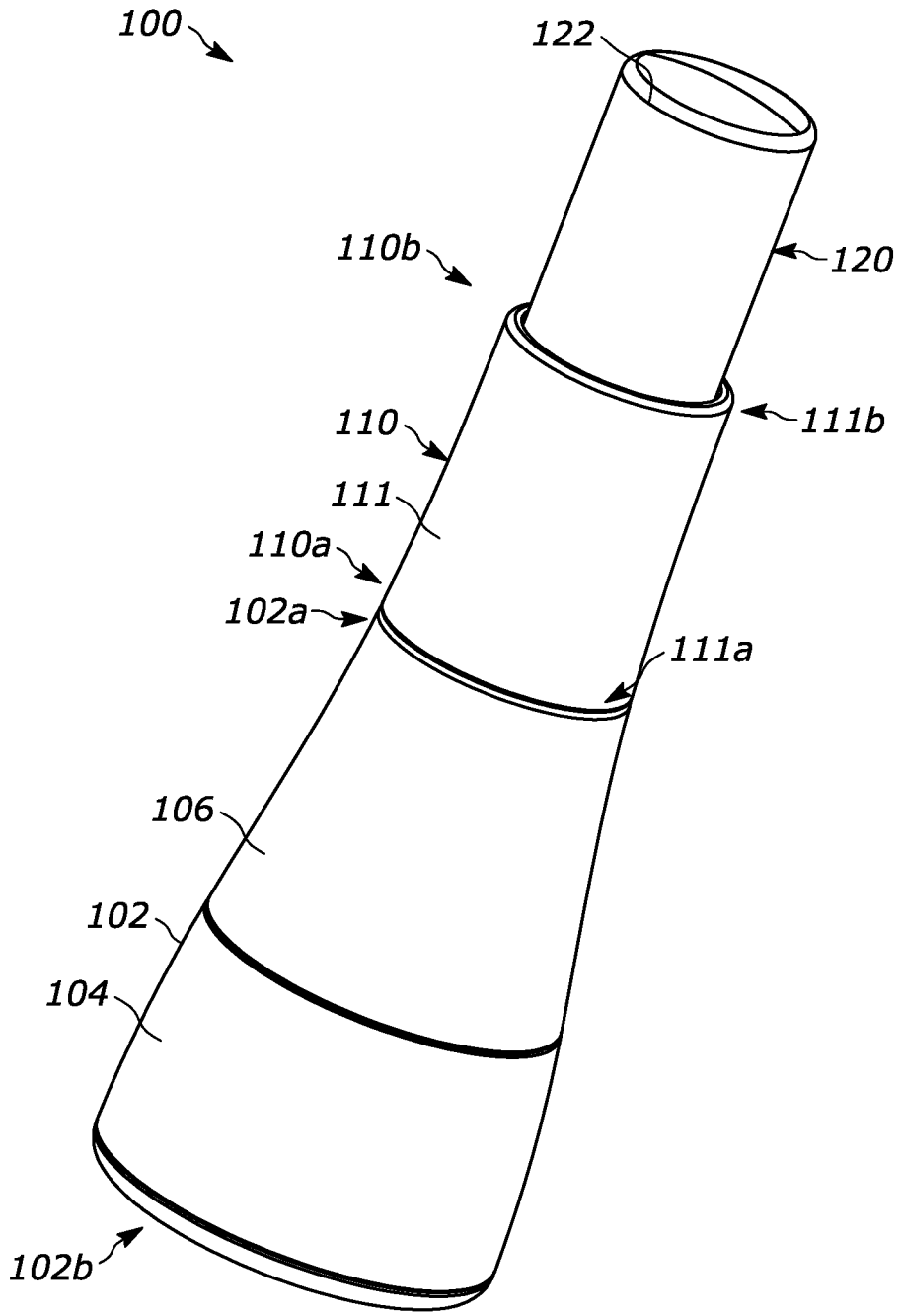
FIG. 1 illustrates a perspective view of an example applicator system in accordance with various embodiments.
Figure 2:
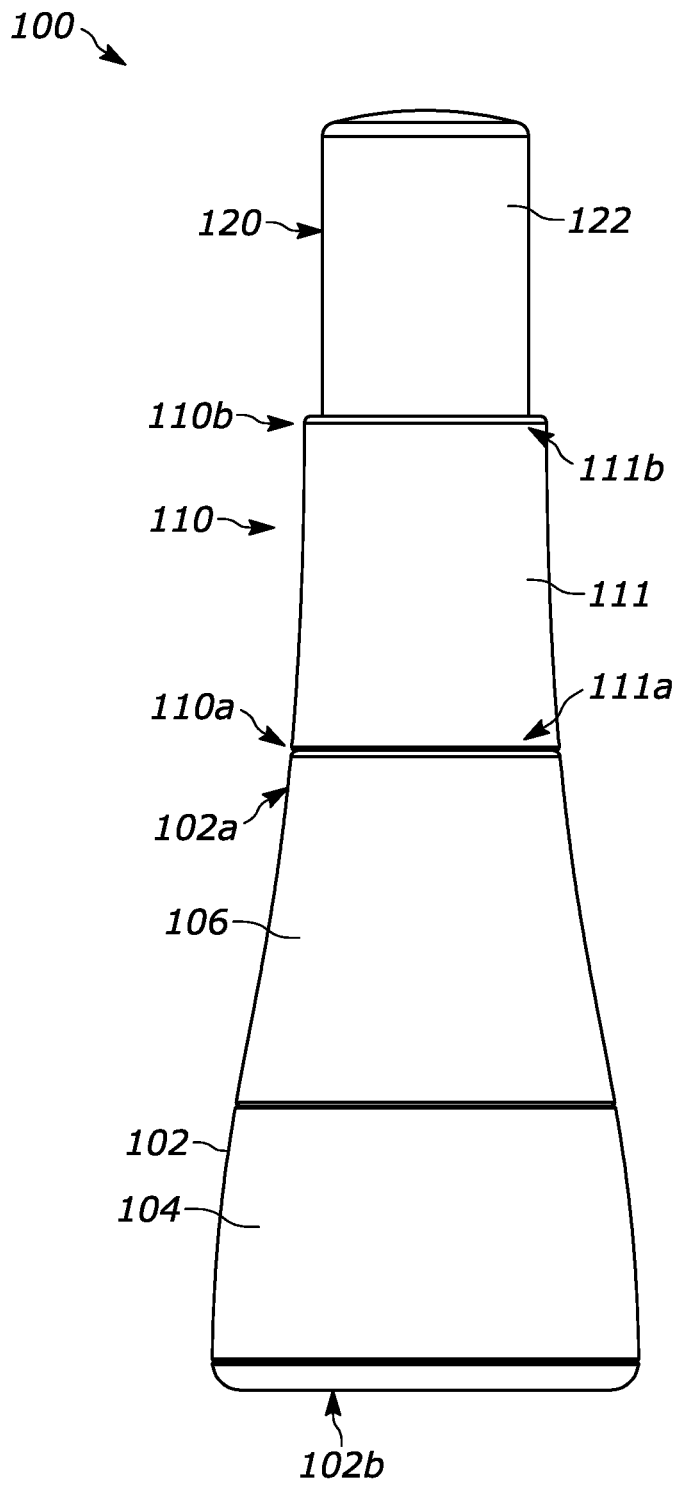
FIG. 2 illustrates a front elevation view of the example applicator system of FIG. 1 in accordance with various embodiments.
Figure 3:
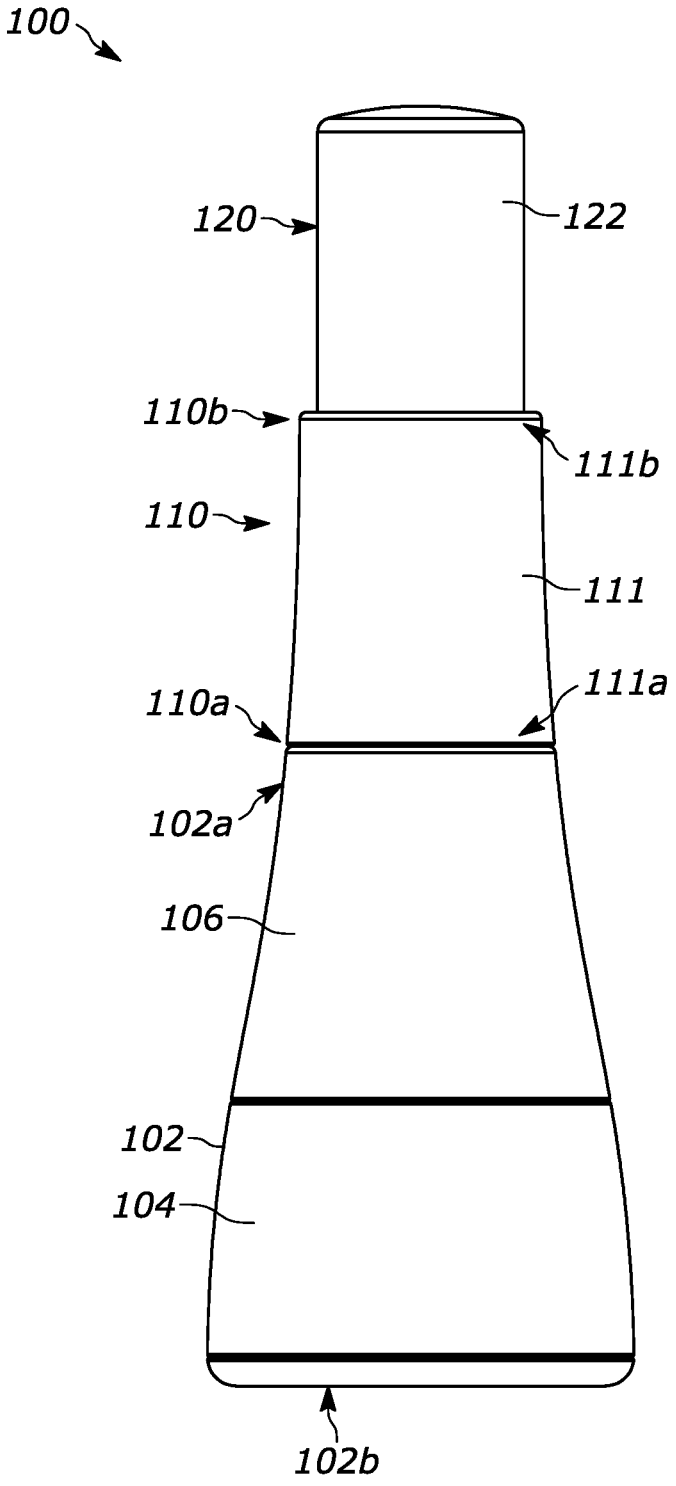
FIG. 3 illustrates a side elevation view of the example applicator system of FIGS. 1 & 2 in accordance with various embodiments.
Figure 4:
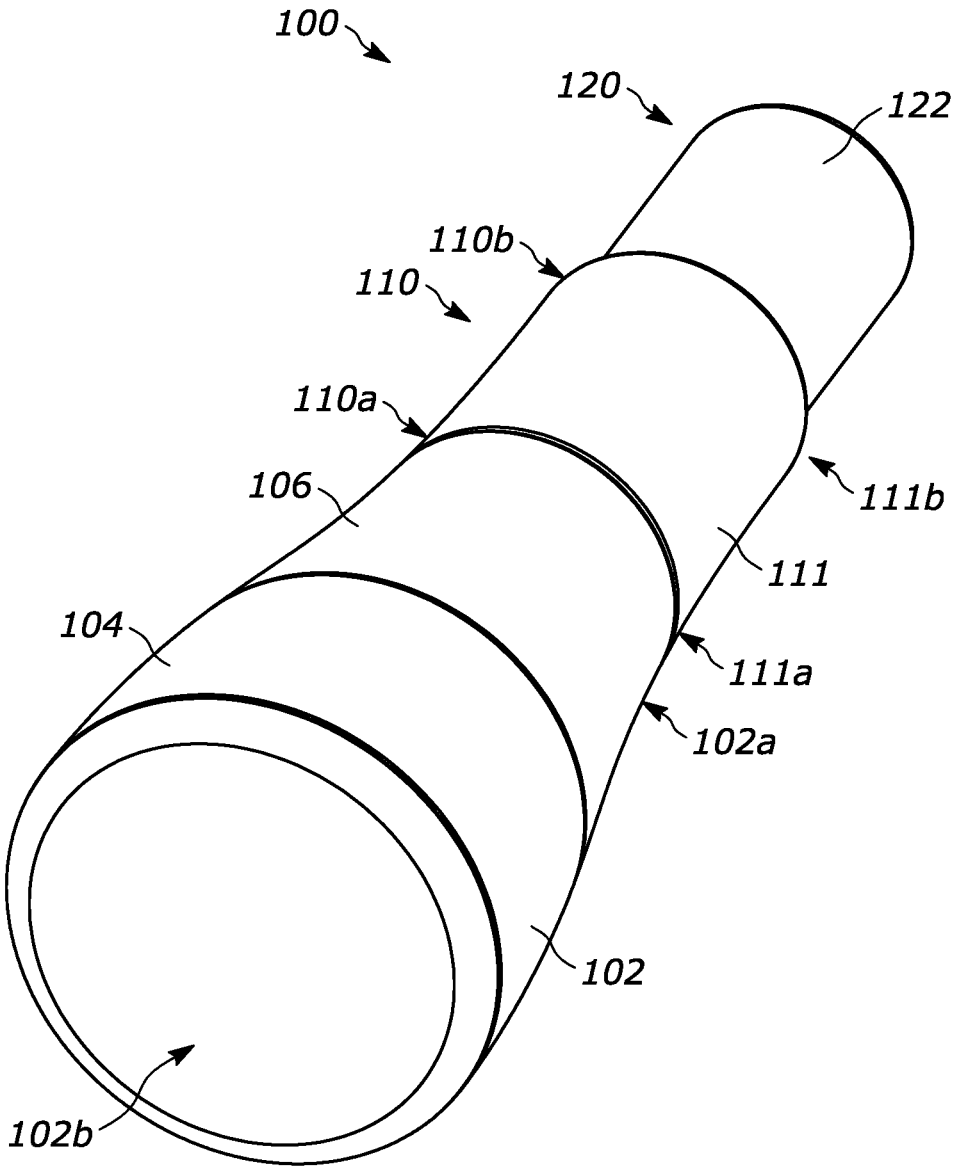
FIG. 4 illustrates a lower perspective view of the example applicator system of FIGS. 1-3 in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, an applicator system is provided that allows a user to precisely dispense and apply a controlled, predetermined quantity (e.g., a micro dosage) of a cosmetic, a hair care, a body care, and/or a skincare product such as, for example, a concealer formula, and allows the product to be applied and blended in an ergonomic and even manner. In some examples, the system may reduce air bubbles and/or other inconsistencies during dispensing and application, thereby providing a smooth application that reduces and/or eliminates texture marks.

Turning to the Figures, an applicator system 100 is provided for containing and dispensing a cosmetic substance 101. The applicator system 100 includes a container or cartridge 102, a dispensing mechanism 110, and an applicator 130. The cosmetic substance 101 may be any type of cosmetic, hair care, body care, and/or skincare product that may be applied to a user. For example, the cosmetic substance 101 may be in the form of a concealer formula. Other examples are possible.

Figure 5:
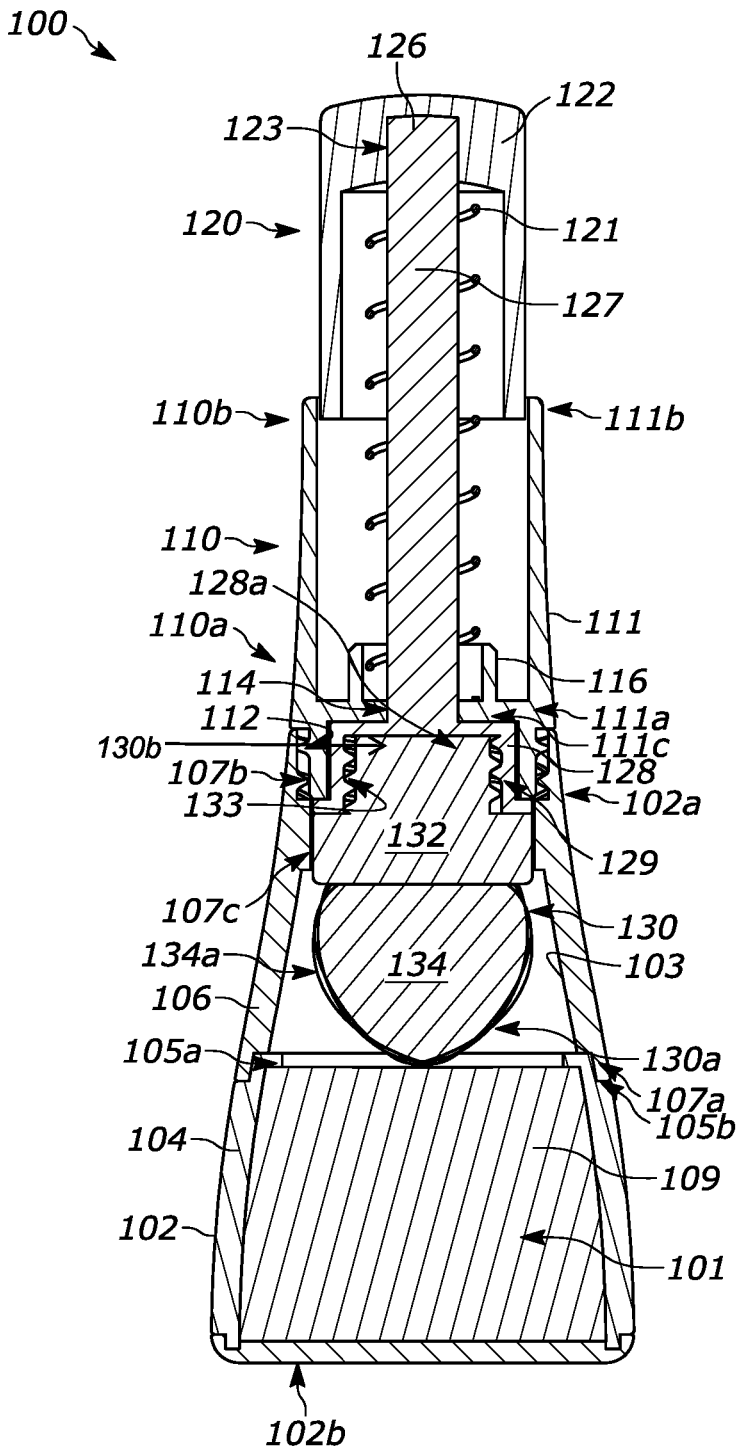
FIG. 5 illustrates a front elevation cross-sectional view of the example applicator system of FIGS. 1-4 in accordance with various embodiments.

The container 102 has a first end 102*a*, a second end 102*b*, and defines a cavity 103 dimensioned to retain the cosmetic substance 101. More specifically, the container 102 includes a base portion 104 and an extension portion 106 which cooperate to define the cavity 103. As illustrated in FIG. 5, the base portion 104 is dimensioned to retain the cosmetic substance 101 therein, and includes a generally flat lower surface to allow the container 102 to rest on a generally flat surface. The container 102 may be constructed from any number of suitable materials such as, for example, a polymeric material, a metallic material, and/or a glass material. Other examples are possible. In some examples, the first end 102*a* of the container 102 may be open, and the second end 102*b* of the container 102 may be closed.

The extension portion 106 of the container 101 is operably coupled with the base portion 104 of the container 101 via any number of suitable approaches. For example, the extension portion 106 may be coupled with the base portion 104 via a frictional engagement, a threaded engagement, and/or other suitable approaches. As illustrated in FIG. 5, the base portion 104 includes an inner flange 105*a* and an outer ledge 105*b*. The extension portion 106 includes an outer flange 107*a* that engages the outer ledge 105*b* of the base portion 104. It is to be appreciated that in some examples, (not illustrated) the base and extension portions 104, 106, may be integrally formed with each other.

As illustrated in FIG. 5, in some examples, the first end 102*a* of the container includes a threaded coupling region 107*b*, which, in this example, is a part of the extension portion 106. As will be discussed in further detail, the extension portion 106 further includes a guiding surface 107*c*.

In some examples, the container 102 may be at least partially constructed from a transparent and/or a translucent material, and may accommodate between approximately 3 ml and approximately 15 ml of cosmetic substance 101. More specifically, in some examples, the cavity 103 may be dimensioned to accommodate approximately 6 ml of cosmetic substance 101. In some forms (not illustrated), the container 102 may be configured to receive an internal pouch that may be removable therefrom.

The dispensing mechanism 110 is operably coupled with the first end 102*a* of the container 102 and has a first end 110*a* and a second end 110*b*. Generally, the dispensing mechanism 110 includes an elongated body 111 and an actuator assembly 120. The elongated shell or body 111 is generally hollow and includes a first end 111*a*, a second end 111*b*, a lower surface 111*c* and a mating member in the form of a threaded coupling region 112 disposed at or near the first end 110*a* of the dispensing mechanism 110. Further, in some examples, the elongated body 111 may include a throughbore 114 disposed at or near the first end 110*a* of the dispensing mechanism 110. Further still, in some examples, the elongated body 111 may include a retaining member 116 disposed at or near the first end 110*a* of the dispensing mechanism 110. It is appreciated that any of the threaded coupling region 112, the throughbore 114, and/or the retaining member 116 may be disposed at other locations along the elongated body 111 as desired.

As illustrated in FIG. 5, the threaded coupling region 112 of the elongated body 111 engages the threaded coupling region 107*b* of the extension portion 106 to operably couple the elongated body 111 with the extension portion 106 (and thus the container 102). It is appreciated that other suitable approaches for removably coupling the elongated body 111 with the extension portion 106 may be used such as, for example, a friction-fit engagement, corresponding notch and groove couplings, and the like.

The retaining member 116 is in the form of a ring that extends upwardly from the lower surface 111*c* and into the interior cavity thereof. Further, in the illustrated example, the retaining member 116 is positioned such that it surrounds the throughbore 114. While the illustrated example depicts a retaining member 116 in the form of a continuous ring, in other examples (not illustrated), the retaining member may be a discontinuous ring and/or a single protrusion. Other arrangements are possible.

The actuator assembly 120 includes a resilient member 121, a button 122, and a piston member 126. The button 122 is dimensioned to be translatably coupled with the elongated body 111 to permit relative movement in an axial direction therebetween. More specifically, the button 122 is dimensioned to be at least partially disposed within a portion of the elongated body 111. In some examples, one of elongated body 111 or the button 122 may have a groove (not illustrated) formed therein, and the other of the button 122 or the elongated body 111 may have a corresponding protrusion or notch (not illustrated) to guide relative movement therebetween. In any of these examples, the button 122 may include a tab or other locking mechanism to prevent the button 122 from becoming decoupled from the elongated body 111.

The button 122 further includes a coupling cavity 123 adapted to receive a portion of the piston member 126. More specifically, the piston member 126 includes a rod 127 and a piston head 128. In the illustrated example, the rod 127 is disposed within the coupling cavity 123 of the button 122 such that the piston member 126 moves axially with the button 122 relative to the elongated body 111 (and accordingly, relative to the container 102). The engagement between the rod 127 and the coupling cavity 123 may be in the form of a threaded coupling, a friction-fit coupling, or any other suitable approach. Further, the rod 127 is disposed through the throughbore 114 of the elongated body 111. So configured, the piston head 128 is positioned at or near the first end 111*a* of the elongated body 111 and below the lower surface 111*c* thereof, and may move in an axial direction such that the piston head 128 extends a distance beyond the first end 111*a* of the elongated body 111. The piston head 128 includes a cavity 128*a* defining an applicator coupling mechanism 129. In the illustrated example, the applicator coupling mechanism 129 is in the form of a threaded coupling region, though other arrangements are possible.

The resilient member 121 is in the form of a spring that is disposed within the elongated body 111 and the button 122. More specifically, a first end of the resilient member 121 is coupled with the retaining member 116. In some examples, the resilient member 121 may be disposed about a periphery of the retaining member 116, and in other examples, the resilient member 121 may be disposed within an internal cavity formed by the retaining member 116. In yet other examples, the resilient member 121 may be coupled with the retaining member 116 via mechanical fasteners or other suitable approaches. The second end of the resilient member 121 is positioned adjacent to the coupling cavity 123 of the button 122. So arranged, the resilient member 121 is adapted to urge the button in an axial direction away from the second end 111*b* of the elongated body 111. In this arrangement, because the rod 127 is coupled with the button 122 and the piston head 128 is positioned below the lower surface 111*c* of the elongated body 111, the piston head 128 will prevent the button 122 from moving axially away from the second end 111*b* of the elongated body 111 to a distance that would cause the elongated body 111 and the button 122 to be decoupled from each other. In some examples, the resilient member 121 may be constructed from a plastic or other polymeric material that is environmentally sustainable. Other suitable materials are possible.

The applicator 130 has a first end 130*a*, a second end 130*b*, a body 132, and a compressible member 134. The compressible member 134 is positioned at the first end 130*a*, and the body 132 is positioned at the second end 130*b*. The body 132 of the applicator 130 may be in the form of a rigid collar that includes a piston member coupling mechanism 133 that may be used to threadably couple the applicator 130 with the piston member 126. More specifically, the applicator coupling mechanism 129 of the piston head 128 engages the piston member coupling mechanism 133. As illustrated in FIG. 5, the body 132 of the applicator 130 is positioned within the guiding surface 107*c* of the extension portion 106 such that it (in addition to a portion of the piston head 128) may be slidable and/or translatable relative to the guiding surface 107*c*.

The compressible member 134 is coupled with the base 132 via any number of suitable approaches such as, for example, via adhesives, ultrasonic welding, a friction-fit connection, and the like. In some examples, the compressible member 134 is constructed from a flocked soft foam having a porosity that allows the cosmetic substance 101 to diffuse through and be evenly dispersed along an external surface 134*a* thereof. By using a flocked foam material, the external surface 134 provides a smooth application of the cosmetic substance 101. In some examples, the compressible member 134 is approximately 5 mm thick and may have a domed, slanted face having a petal shape that mimics a user's finger with a width of approximately 17 mm. In these and other examples, a tip of the compressible member 134 may be pointed to allow for targeted application of the cosmetic substance 101. Other examples are possible.

In operation, the applicator system 100 is prepared by filling the cavity 103 with a cosmetic substance 101. In some examples, a user may purchase a standalone container 102 that is prefilled with the desired cosmetic substance 101. The assembled dispensing mechanism 110 and actuator assembly 120 are then coupled with the container 102 by threadably engaging the threaded coupling region 112 of the elongated body 111 with the threaded coupling region 107*b* of the extension portion 106. So arranged, and as illustrated in FIG. 5, the compressible member 134 of the applicator 130 is disposed within the cavity 103 of the container and is positioned above the cosmetic substance 101 contained therein.

A user may then press the button 122 downwards (i.e., towards the first end 111*a* of the elongated body 111), which causes the piston member 126 and the applicator 130 to lower and the compressible member 134 to collect a predetermined quantity of cosmetic substance 101. More specifically, in some examples, the maximum allowable travel of the button 122 relative to the elongated member 111 is predefined such that upon lowering the compressible member 134, a desired microdosage (e.g., between approximately 5 microliters and approximately 20 microliters and preferably approximately 10 microliters) may be collected by the compressible member 134. In some examples, the cosmetic substance 101 may be drawn onto the external surface 134*a* thereof, and in other examples, the porosity of the compressible member 134 may cause a quantity of the cosmetic substance 101 to be collected and drawn into an internal portion thereof.

The user may then release the button 122 upon which the resilient member 121 will cause the button 122, the piston member 126, and the applicator 130 to move axially upwards such that the compressible member 134 is removed from the cosmetic substance 101. With brief reference to FIG. 8, the user may then decouple (e.g., unscrew) the threaded coupling region 112 of the elongated body 111 from the threaded coupling region 107*b* of the extension portion 106 of the container 102, whereupon the compressible member 134 of the applicator 130 is exposed for use. The user may grasp the elongated body 111 (which, in some examples, may include a gripping member and/or may be ergonomically designed for comfortable handling) and apply the cosmetic substance 101 by pressing the external surface 134*a* of the compressible member 134 against their skin, which causes the cosmetic substance 101 disposed on or within the compressible member 134 to flow onto their skin. Upon applying the cosmetic substance 101, the user may secure the elongated member 111 with the extension portion 106 via the threaded coupling regions 112, 107*b*. The user may repeat this process as desired to collect and apply additional cosmetic substance 101.

It is to be appreciated that in some approaches, the dispensing mechanism may include a locking mechanism (not illustrated) to prevent the button 122 from being engaged. For example, the button 122 may incorporate a feature where it must be first twisted relative to the elongated body 111 in order to be depressible. Other examples are possible.

The applicator 130 must translate a known distance into the cavity 103 of the container 102 to properly collect a desired predetermined quantity of cosmetic substance 101. In some examples, the dispensing mechanism 110 may include a translation limiting member (not illustrated) in the form of a notch or protrusion that prevents the button from moving beyond a desired axial distance. In some examples, the ratio of the stroke of the resilient member 121 and the thickness of the compressible member 134 are optimized to provide full evacuation of the cosmetic substance 101 from the container 102. Further, in some examples, the external surface 134*a* of the compressible member 134 is equivalent to the upper dimension (e.g., diameter) of the container 102 to provide for homogenous transfer of the cosmetic substance 101.

In some examples, the cosmetic substance 101 may be disposed within a retaining medium 109 that suspends the cosmetic substance 101 within the cavity 103. Advantageously, such a retaining medium 109 may prevent the cosmetic substance from spilling if the system 100 is placed on its side. More specifically, the retaining medium 109 may be in the form of a foam or mesh member. In such examples, upon pressing the button 122 to lower the applicator 130, the compressible member 134 may compress against an upper surface of the retaining medium 109 to break a surface tension formed by the cosmetic substance 101 thereon. Such compression may act as a partial vacuum that causes the cosmetic substance 101 to be drawn into the compressible member 134 upon releasing the button 122. In examples where a retaining medium 109 is used, the inner flange 105*a* of the base portion 104 may serve as a retention mechanism that keeps the retaining medium 109 within the base portion 104 of the container 102. In some examples, the retaining medium 109 may include a central region (not illustrated) that is depressed and/or shaped correspondingly with the shape of the applicator 130. In such arrangements, upon depressing the applicator 130, the retaining medium 109 may engage the applicator 130 in a uniform manner such that the cosmetic substance 101 is evenly applied to the outer surface of the applicator 130. Other examples are possible.

Further, in some examples where a foam retaining medium 109 is used, different layers of foam having varying porosities may be used to drive the cosmetic substance 101 towards the top. For example, a higher density foam material may be used at the bottom of the retaining medium 109, and a lower density foam material may be used at the top of the retaining medium 109. Such a configuration may result in capillary action whereby the cosmetic substance 101 is urged upwards. Other examples are possible.

Figure 6:
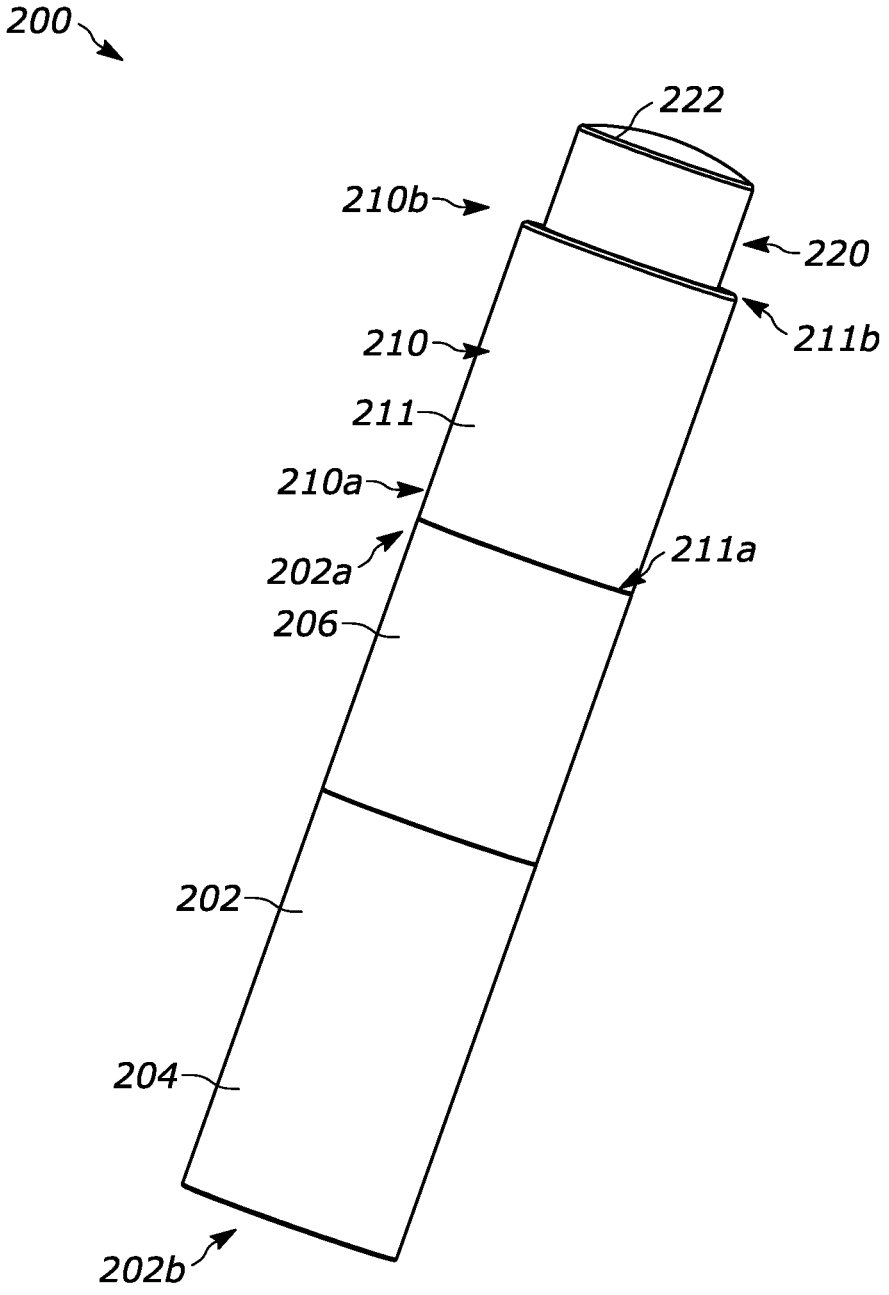
FIG. 6 illustrates a perspective view of a second example applicator system in accordance with various embodiments.
Figure 7:
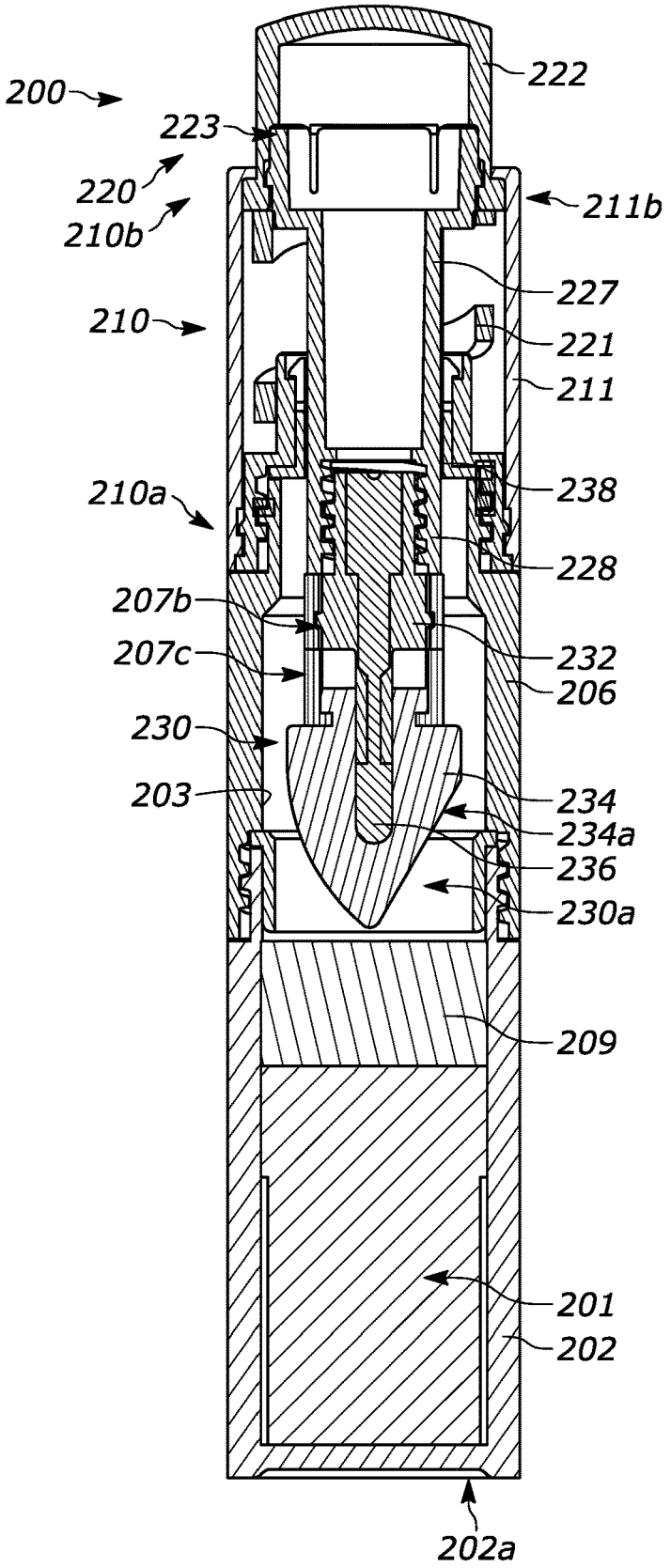
FIG. 7 illustrates a front elevation cross-sectional view of the example applicator system of FIG. 6 in accordance with various embodiments.
Figure 8:
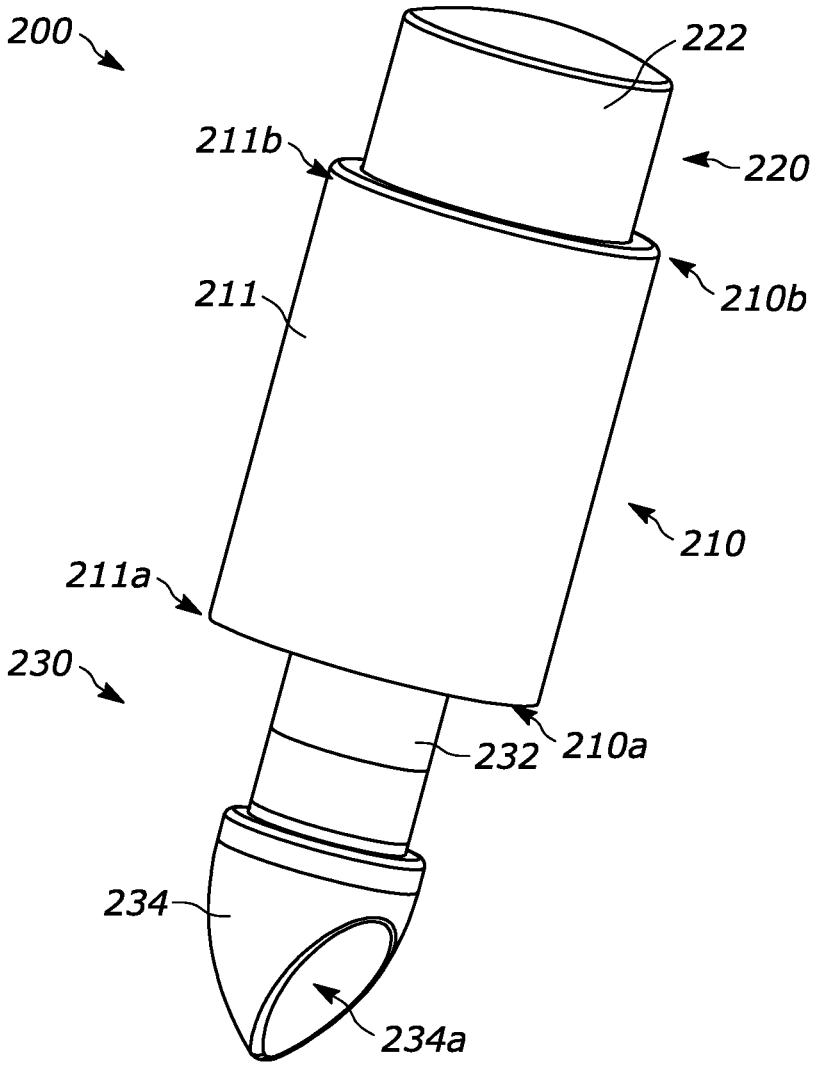
FIG. 8 illustrates a perspective view of a portion of the second example applicator system of FIGS. 6 & 7 removed from an example container in accordance with various embodiments.

It is appreciated that the applicator systems described herein may be provided with any number of additional and/or alternative features. For example, FIGS. 6-8 illustrate an alternative applicator system 200. It is appreciated that the applicator system 200 illustrated in FIGS. 6-8 may include similar features to the applicator system 100 illustrated in FIGS. 1-5, and accordingly, elements illustrated in FIGS. 6-8 are designated by similar reference numbers indicated in the example illustrated in FIGS. 1-5 increased by 100. Accordingly, these features will not be described in substantial detail. Further, it is appreciated that any of the elements described with regards to the applicator system 100 may be incorporated into the applicator system 200, and vice-versa.

In this example applicator system 200, at least a portion of the external surface 234*a* of the compressible member 234 includes an angled portion, which may assist with applying the cosmetic substance 201 in particular techniques. Further, in the illustrated example, the applicator 230 may have a tube 236 disposed therewithin. The tube 236 may be constructed from any number of suitable materials such as, for example, a thermoplastic elastomeric material or other suitable flexible material that moves and/or bends when pressure is applied to the applicator 230, but may still provide increased support during application of the cosmetic substance 201. Further still, in the illustrated example, the applicator 230 may include a support member 238 in the form of a rigid collar that surrounds a portion of the applicator 230 to provide additional support when a user applies increased pressure to the applicator 230 during specific application techniques. Other examples are possible.

Because the applicator system 100 includes threadable or otherwise removable components, the applicator 130 may be separated from the remainder of the applicator system 100 as desired and interchanged with different applicators having desired geometries and/or other characteristics such as, for example, softer or more rigid foam materials. Accordingly, the system 100 may be customizable to meet varying consumer demands. Such a removable arrangement further allows the applicator 130 to be adequately cleaned and replaced as needed, which may be advantageous in retail environments to promote hygienic practices.

Further, any of the applicator systems 100, 200 described herein may be reusable. More specifically, in some examples, upon using all of the cosmetic substance 101, a user may remove the container 102 from the dispensing mechanism 110 (and/or, in some examples, may remove the base portion 104 from the extension portion 106) and return the container 102 to the manufacturer. The user may then purchase a standalone container 102 having a seal or cap arrangement (not illustrated) on the first end 102*a* thereof, and subsequently couple the dispensing mechanism 110 therewith. Such a system may result in significant reductions in packaging waste.

So configured, the system allows a consumer to actuate, apply, and blend the product in an efficient manner. The applicator head geometry allows the product to diffuse to the surface for a more homogenous application, while the pointy upper region of the applicator head provides better application. By providing two orifice restrictions, displacement within the dispensing mechanism is accurately controlled, which is not possible with existing systems and pumping mechanisms. Further, because each of the components are removably coupled with each other, the system 100 may be readily customized as desired by a user.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. An applicator system for containing and dispensing a cosmetic substance, the system comprising:

a container defining a cavity containing a cosmetic substance and including an open first end, an extension portion, and a base portion removably coupled with the extension portion;

a dispensing mechanism operably coupled with the first end of the container, the dispensing mechanism including an elongated body and an actuator assembly operably coupled therewith, the elongated body having a first end and a second end;

an applicator operably coupled with the actuator assembly and being positioned at or near the first end of the elongated body and the first end of the container;

wherein upon engaging the actuator assembly, the applicator is urged towards the cavity of the container to collect a quantity of cosmetic substance, the applicator configured to be positioned within the extension portion of the container when the base portion of the container is decoupled from the extension portion.

2. The applicator system of claim 1, wherein the actuator assembly is translatably coupled with the elongated body to permit relative movement therebetween.

3. The applicator system of claim 2, wherein the actuator assembly includes a button and a resilient member that urges the button towards the second end of the elongated body whereby the applicator is positioned near the cavity of the container.

4. The applicator system of claim 3, further including a locking mechanism adapted to prevent the button from being engaged.

5. The applicator system of claim 1, further including a retaining medium adapted to suspend the cosmetic substance within the cavity.

6. The applicator system of claim 5, wherein the retaining medium includes at least one of a foam member or a mesh member.

7. The applicator system of claim 1, wherein the first end of the elongated body includes a mating member to releasably secure the dispensing mechanism with the container.

8. The applicator system of claim 1, wherein the applicator is removably coupled with the actuator assembly.

9. The applicator system of claim 1, wherein the applicator is constructed from a compressible material adapted to compress upon being urged towards the cavity of the container.

10. A dispensing mechanism for an applicator system containing a cosmetic substance, the dispensing mechanism comprising:

an elongated shell having a first end and a second end, the first end including a throughbore and a lower surface;

an actuator assembly at least partially disposed within the elongated shell, the actuator assembly including a button and a piston member operably coupled with the button, the piston member including a rod and a piston head having an applicator coupling mechanism, the rod disposed through the throughbore of the first end of the elongated shell and the piston head configured to be positioned against the lower surface of the first end of the elongated shell; and an applicator including a base and a compressible member operably coupled therewith, the base including a piston member coupling mechanism to operably couple with the applicator coupling mechanism of the piston member.

11. The dispensing mechanism of claim 10, wherein the actuator assembly is translatable relative to the elongated shell such that upon engaging the button, the actuator assembly moves towards the first end of the elongated shell.

12. The dispensing mechanism of claim 11, wherein upon the actuator assembly moving to an extended position, the compressible member is adapted to extend a distance beyond the first end of the elongated shell.

13. The dispensing mechanism of claim 11, wherein the actuator assembly further includes a resilient member operably coupled with the button and a portion of the elongated shell, the resilient member adapted to bias the button toward the second end of the elongated shell.

14. The dispensing mechanism of claim 11, further including a locking mechanism adapted to prevent the button from being engaged.

15. The dispensing mechanism of claim 11, further including a translation limiting member adapted to limit translation of the actuator assembly relative to the elongated shell.

16. The dispensing mechanism of claim 10, wherein the applicator is removably coupled with the piston member.

17. The dispensing mechanism of claim 10, wherein the first end of the elongated shell includes a mating member to releasably secure the dispensing mechanism with a container containing a cosmetic substance.

* * * * *